US006621233B2

(12) United States Patent
Kawano

(10) Patent No.: US 6,621,233 B2
(45) Date of Patent: Sep. 16, 2003

(54) POWER CIRCUIT FOR DRIVING LIQUID CRYSTAL DISPLAY PANEL

(75) Inventor: Hiroaki Kawano, Miyazaki (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 10/158,128

(22) Filed: May 31, 2002

(65) Prior Publication Data

US 2002/0195965 A1 Dec. 26, 2002

(30) Foreign Application Priority Data

Jun. 25, 2001 (JP) ..... 2001-190871

(51) Int. Cl.[7] ..... G09G 3/10; G05F 1/10
(52) U.S. Cl. ..... 315/169.3; 345/204; 345/212
(58) Field of Search ..... 315/169.1–169.4; 345/87, 91, 98, 100, 212, 254, 204

(56) References Cited

U.S. PATENT DOCUMENTS 5,508,591 A * 4/1996 Kanemori et al. ..... 315/169.3
6,459,330 B2 * 10/2002 Yasue ..... 345/212

FOREIGN PATENT DOCUMENTS

| | | |
|---|---|---|
| JP | 5-232447 | 9/1993 |
| JP | 6-130919 | 5/1994 |
| JP | 11-14961 | 1/1999 |
| JP | 11-52916 | 2/1999 |
| JP | 11-167366 | 6/1999 |

* cited by examiner

*Primary Examiner*—Don Wong
*Assistant Examiner*—Wilson Lee
(74) *Attorney, Agent, or Firm*—Wenderoth, Lind & Ponack, L.L.P.

(57) ABSTRACT

A power circuit for driving a liquid crystal display panel whereby an afterglow can be prevented from coming out on the liquid crystal display panel when the liquid crystal display panel is turned off. A power down short circuit 10 arranged in a driving power circuit 1 is characterized in that it includes a plurality of power source lines VL1~VL5 provided corresponding to a plurality of voltage level V1~V5 and also include a plurality of N-channel MOS transistors M6~M9 short-circuiting adjacent power source lines each other when detecting if the liquid crystal display line has been turned off. The afterglow is prevented from coming out on the liquid crystal display panel by preventing the lights-on of the liquid crystal element that is caused by a slow fall time of the electric potential of the power source line.

13 Claims, 9 Drawing Sheets

POWER CIRCUIT FOR DRIVING LIQUID CRYSTAL DISPLAY PANEL

BACKGROUND OF THE INVENTION

1. Field of the Invention

The present invention relates to a power circuit for driving a liquid crystal display panel, and more particularly to a circuit for quickly lowering the electric potential inside the driving power circuit in a very short period of time after having turned off the power circuit for driving the liquid crystal display panel.

2. Related Art

As well known, the liquid crystal display panel is a device which is generally made up of two electrode plates provided with a plurality of electrodes and a liquid crystal as is put between these two electrode plates, and displays an image on the display panel when a predetermined voltage is applied to the liquid crystal through respective those electrodes. In this specification, the electrode provided on the above two electrode plates and led in the lateral direction is called a common electrode (referred to as 'COM' hereinafter) while the electrode provided on the above two electrode plates but led in the longitudinal direction is called a segment electrode (referred to as 'SEG' hereinafter). When the potential difference between the COM and the SEG is equal to or larger than a predetermined value, the liquid crystal positioned at the intersection of the COM and the SEG is turned on while the above liquid crystal is turned off (non-lit state) when the above potential difference is smaller than the predetermined value.

FIG. 7 is a diagram showing an example of a wave form describing the relation between the potential difference between the COM and the SEG, and the lights-on/lights-out of the liquid crystal. In this example, the voltage level (electric potential) of the COM or the SEG is in a relation of V1>V2>V3>V4>V5>VSS (VSS: the ground potential GND), and the liquid crystal at the intersection of the COM and the SEG is set to be in the lights-on state if the potential difference between the COM and the SEG is equal to or higher than |V1| while the above liquid crystal is set to be in the lights-out state if the potential difference between the COM and the SEG is lower than |V1|.

Up to now, the driving power circuit for the liquid crystal display panel has employed a power down short circuit in order to shorten the fall time of the electric potential inside the driving power circuit after turning off the power source of the liquid crystal display panel. FIG. 8 is a diagram for explaining the change of respective power source potentials V1~V5 within the driving power circuit when operating the power down short circuit, that is, the change of respective power source potentials V1~V5 from the time of starting the operation of the power down short circuit after turning off the power source of the liquid crystal display panel to the time of ending the operation of the power down short circuit.

The power down short circuit as described above will now be explained with reference to FIG. 9. In the power down short circuit 50 as shown in FIG. 9, in order to detect if the power source of the liquid crystal display panel has been certainly turned off, in other words, that the level of the VDD power source has surely dropped down, a certain arbitrary level difference is generated between nodes B and C by means of condensers C1 and C2 for generating the level difference and diodes D1 and D2 for generating the level difference. A resistance R1 provided on the VDD power source line, resistances R2~R6 provided on each of power source lines, and a resistance R7 provided on the power source line of a level comparator 51 are noise absorption resistances for absorbing noises which might be included in the corresponding power source lines. A logical value of a node A is inverted by means of the level comparator 51, based on the level difference between the nodes B and C.

That is, when detecting if the level of the VDD power source has dropped down (i.e. when the power source of the liquid crystal display panel is turned off), the level of the node A is inverted from the L-level to the H-level. With this inversion of the node A to the H-level, a plurality of N-channel MOS transistors M1~M5 are turned on, thereby short-circuiting the power lines VL1~VL5 provided corresponding to voltage levels V1~V5 to the ground.

By the way, it is a general way that some external condensers are fitted to the driving power circuit of the liquid crystal display panel for stabilization of the voltage level. Furthermore, in case of making use of the power source lines VL1~VL5 of the above-mentioned driving power circuit for instance, it is needed to keep the relative level height relation existing among the voltage levels of the power source lines unchanged, taking account of the relation of the power sources for the lights-on and the lights-out. Accordingly, when applying the driving power circuit to the liquid crystal display device having the characteristic as shown in FIG. 7, it is needed to keep the relative level height relation existing among voltage levels, that is, V1>V2>V3>V4>V5, unchanged.

As described in the above, the power down short circuit starts its operation as soon as the power circuit for driving the liquid crystal display panel is turned off, thereby short-circuiting the power source lines VL1~VL5 to the ground. However, the voltage levels V1~V5 corresponding to respective power source lines VL1~VL5 can not always fall within an adequately short period of time due to the influence of the external condenser, and this causes such a problem that a certain kind of afterglow comes out on the liquid crystal panel. Furthermore, the operation of the power down short circuit can short-circuit the power source lines VL1~VL5 to the ground, but the falling speed of respective voltage levels can not be always uniform but is apt to become unbalanced. This also causes the problem that a certain kind of afterglow comes out on the liquid crystal display panel.

The present invention has been made in view of the above-mentioned problems as have been experienced so far in connection with the prior art power circuit for driving the liquid crystal display panel. Accordingly, the object of the invention is to provide a novel and improved power circuit for driving the liquid crystal display panel, which is able to prevent any afterglow from coming out on the liquid crystal display panel when the power circuit for driving the liquid crystal display panel is turned off.

SUMMARY OF THE INVENTION

In order to solve the problems as described above, according to the first aspect of the invention, there is provided a power circuit for driving a liquid crystal display panel, which includes a voltage generator for generating a plurality of voltage levels for driving a liquid crystal display panel; a plurality of power source lines provided corresponding to the plurality of voltage levels; a detector for detecting if the liquid crystal display panel has been turned off; a grounding circuit for grounding the plurality of power source lines in response to the detection result obtained by the detector; and a circuit for shorting predetermined power source lines each other in response to the detection result obtained by the detector, wherein the short circuit shorts adjacent power source lines from among the plurality of power source lines each other.

According to the driving power circuit having such a structure as described above, when the detector detects if the liquid crystal display panel has been turned off, a plurality of power source lines are grounded to reduce each electric potential thereof and, at the same time, adjacent power source lines can be short-circuited each other. Consequently, it becomes possible to shorten the fall time of the electric potential of each power source lines. In this specification, the expression "adjacent power source lines" indicate such two power source lines from among a plurality of power source lines that are positioned side by side when arranging all of them in the relative level height order of the electric potential of the power source lines.

As described above, the liquid crystal element of the liquid crystal display panel is lighted when the electric potential difference between the COM and the SEG becomes equal to or higher than a predetermined electric potential (|V1|, for instance). However, after turning off the power source of the liquid crystal display panel, if there still exist some liquid crystal elements having an electric potential near the above predetermined electric potential (V2−VSS=|V2|, for instance) and the electric potential of the power source falls slowly, it happens that those liquid elements are lighted by giving a certain potential difference to them for a certain period of time. That is, this causes an afterglow phenomenon. According to the invention, however, the electric potential of each power source line can be reduced in a shorter fall time, so that the afterglow can be prevented from coming out on the liquid crystal display panel.

Furthermore, according to the second aspect of the invention, there is provided a power circuit for driving a liquid crystal display panel, which includes a voltage generator for generating a plurality of voltage levels for driving a liquid crystal display panel; a plurality of power source lines provided corresponding to the plurality of voltage levels; a detector for detecting if the liquid crystal display panel has been turned off; a grounding circuit for grounding the plurality of power source lines in response to the detection result obtained by the detector; and a circuit for shorting predetermined power source lines in response to the detection result obtained by the detector, wherein the short circuit shorts adjacent power source lines from among the plurality of power source lines without inverting the relative level height order of the electric potential of the plurality of power source lines.

According to the driving power circuit having such a structure as described above, the power source lines are short-circuited without inverting the relative level height order of the electric potential of the power source line, so that the electric potential of each power source line can be reduced in a shorter fall time. For instance, it is possible to always keep the relation of V1>V2>V3>V4>V5(>VSS) unchanged. As will be described later, in order to prevent the afterglow from coming out on the liquid crystal display panel, it is effective to reduce each electric potential level of the power source lines, always keeping the relation of V1>V2>V3>V4>V5(>VSS) unchanged.

Still further, according to the third aspect of the invention, there is provided a driving power circuit for a liquid crystal display panel, which includes a voltage generator for generating a plurality of voltage levels for driving a liquid crystal display panel; a plurality of power source lines provided corresponding to the plurality of voltage levels; a detector for detecting if the liquid crystal display panel has been turned off; a grounding circuit for grounding the plurality of power source lines in response to the detection result obtained by the detector; and a circuit for shorting predetermined power source lines each other in response to the detection result obtained by the detector, wherein the short circuit shorts the power source lines provided in correspondence with the lights-out level of the COM electrodes of the liquid crystal display panel and also short-circuits the power source lines provided in correspondence with the lights-out level of the SEG electrodes of the liquid crystal display panel.

According to the driving power circuit having such a structure as described above, as the short circuit shorts the power source lines provided corresponding to the lights-out level of COM, it become possible to surely discharge the capacitance as charged up on the side of COM. As the short circuit also short-circuits the power source lines provided corresponding to the lights-out level of SEG, it become possible to surely discharge the capacitance as charged up on the side of SEG. Accordingly, the lights-on of the liquid crystal element caused by the longer fall time of the power source line potential is prevented, thus the afterglow being prevented from coming out on the liquid crystal display panel.

Still further, according to the fourth aspect of the invention, there is provided a power circuit for driving a liquid crystal display panel, which includes a voltage generator for generating a plurality of voltage levels for driving a liquid crystal display panel; a plurality of power source lines provided corresponding to the plurality of voltage levels; a detector for detecting if the liquid crystal display panel has been turned off; a grounding circuit for grounding the plurality of power source lines in response to the detection result obtained by the detector; and a circuit for shorting predetermined power source lines each other in response to the detection result obtained by the detector, wherein the short circuit shorts the power source line provided in correspondence with the maximum voltage level and each of the other power source lines each other.

According to the driving power circuit having such a structure as described above, as the short circuit shorts the power source line provided corresponding to the maximum electric potential level and each of the other power source lines each other, the electric potential of each power source line can be reduced in a shorter fall time and also can be held equal to or lower than the maximum electric potential level. For instance, it is possible to always hold the relations of V1≧V2, V1≧V3, V1≧V4 and V1≧V5. Therefore, it become possible to surely reduce each electric potential of the power source lines provided corresponding to the electric potential (V2~V5) lower than the V1, thus the afterglow being prevented from coming out on the liquid crystal display panel.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate preferred embodiments. In the drawings.

DETAILED DESCRIPTION OF THE PREFERRED EMBODIMENTS

Figure 1:
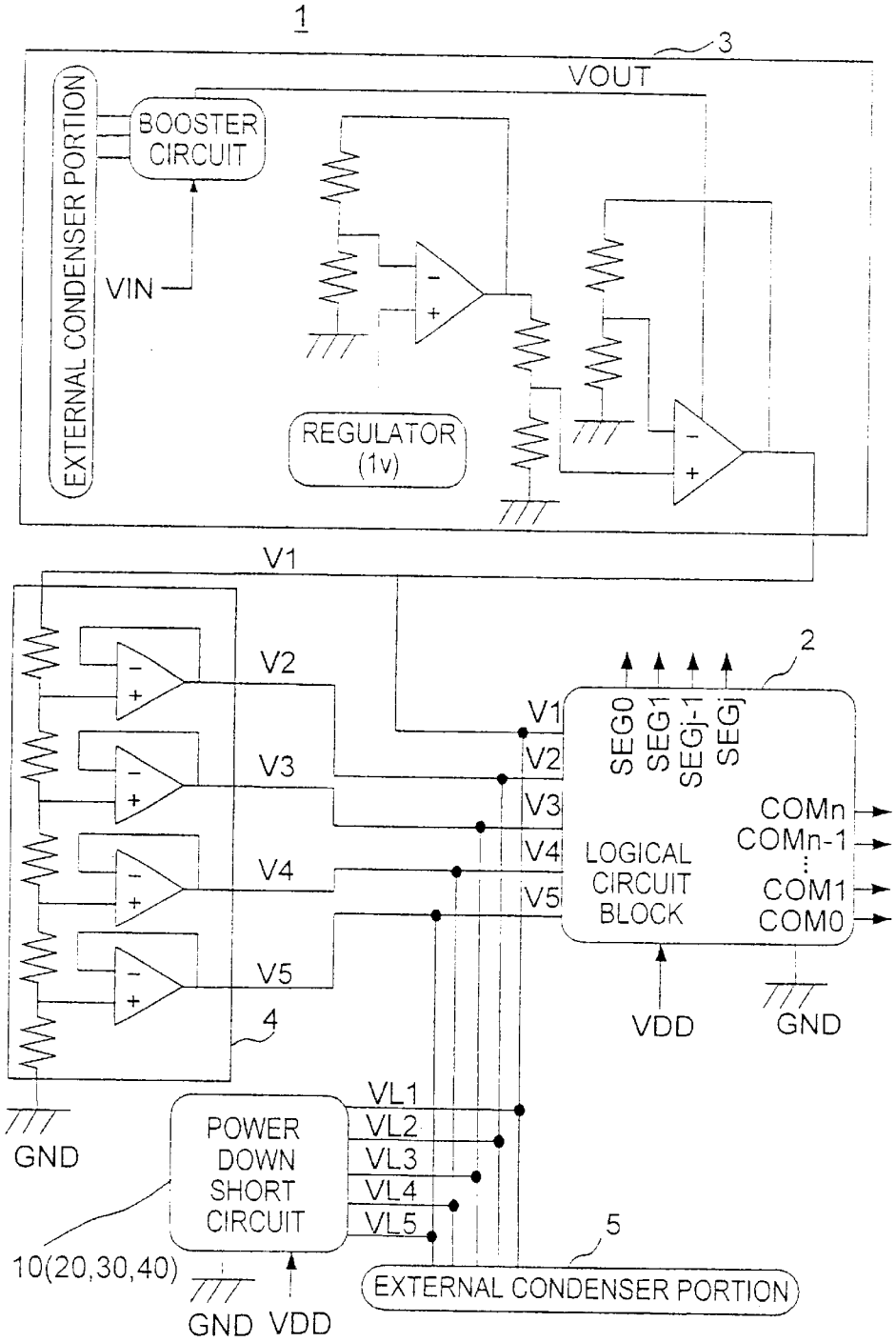
FIG. 1 is a diagram for explaining the outline of a liquid crystal display panel.

Preferred embodiments of the power circuit for driving the liquid crystal display panel according to the invention will now be described in detail with reference to the accompanying drawings. In this specification and the accompanying drawings, the constituents of the invention having a substantially similar function and constitution are designated with an identical reference numeral or character in order to avoid the repetitive and redundant description thereabout.

First of all, let us start describing the whole structure of the power circuit for driving the liquid crystal display panel including a power down short circuit with reference to FIG. 1. As shown in this figure, the driving power circuit 1 is made up of a logical circuit block 2 for supplying predetermined electric potentials to COM's (COM0, COM1, . . . , COMn-1, and COMn) and SEG's (SEG0, SEG1, . . . , SEGj-1, and SEGj) of a liquid crystal display panel (not shown) having a plurality of liquid crystal elements of n×j (n, J: integer, respectively); a booster portion 3 for generating a voltage level V1; an electric potential generation portion 4 for generating electric potential levels V2, V3, V4 and V5 by dividing the voltage level V1 with the help of a resistance-type potential divider; a power down short circuit 10 (20, 30, and 40) for short-circuiting the power source lines VL1~VL5 to the ground; and an external condenser portions 5.

In this embodiment, the voltage levels V1~V5 are set as follows:

Voltage level V1: Electric potential as arbitrarily set to meet the characteristic of the liquid crystal display panel.

Voltage level V2: Lights-out level on the COM side (2)

Voltage level V3: Lights-out level on the SEG side (2)

Voltage level V4: Lights-out level on the SEG side (1)

Voltage level V5: Lights-out level on the COM side (1)

Each embodiment as will be described in the following, is characterized by a power down short circuit included in the power circuit for driving the liquid crystal display panel.

Figure 9:
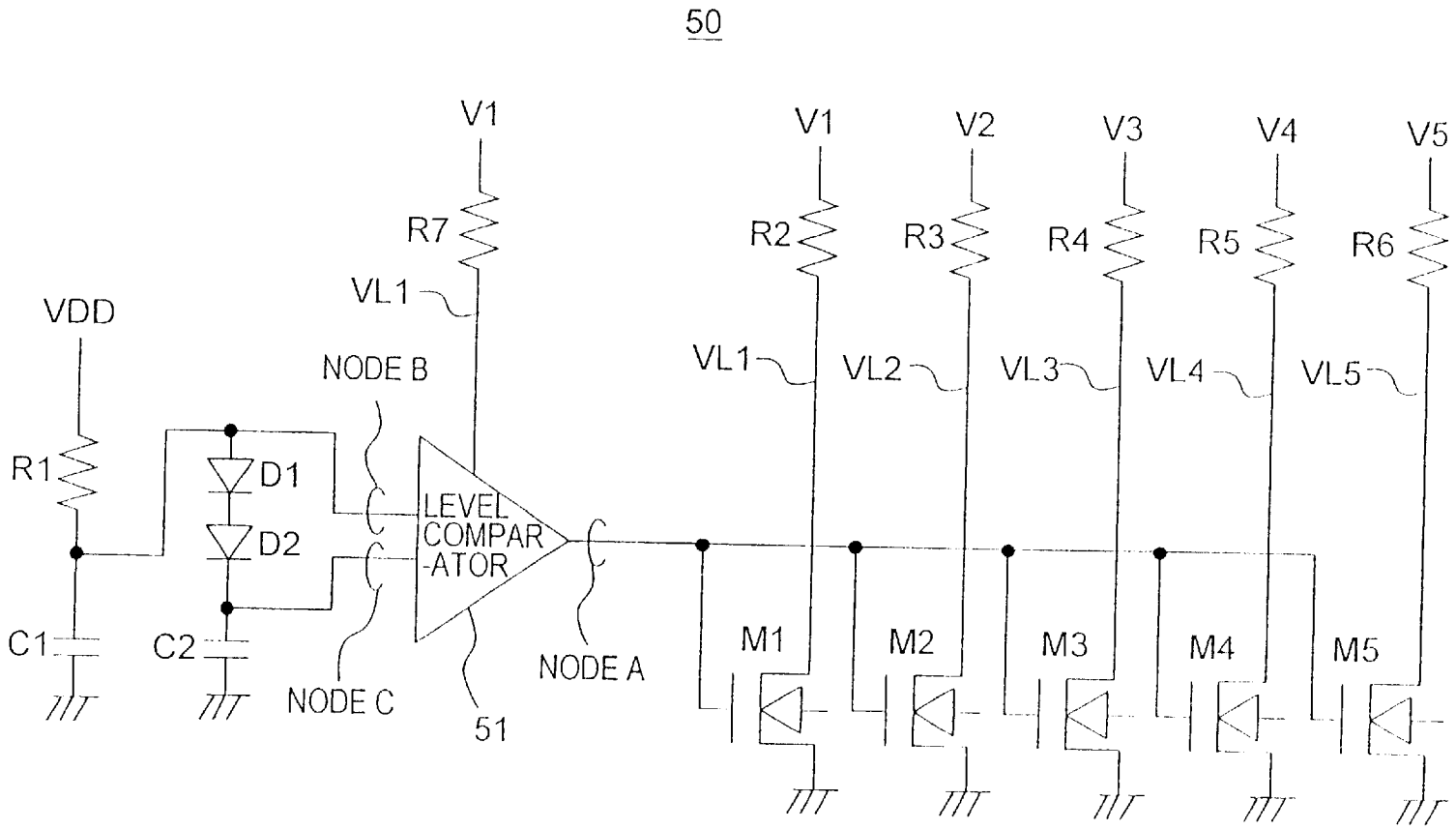
FIG. 9 is a circuit diagram for explaining a prior art power down short circuit.

First of all, for better understanding of the invention, the structure of the prior art power down short circuit 50 will be outlined with reference to FIG. 9. This power down short circuit 50 includes a detector for detecting if the liquid panel has been turned off (i.e. the drop in the level of a VDD power source), the detector being made up of level difference generation condensers C1, C2 and level difference generation diodes D1, D2, by which a level difference is generated between nodes B and C; a level comparator 51 for inverting the logical value of a node A based on the level difference between nodes B and C; a plurality of power source lines VL1~VL5 provided corresponding to a plurality of voltage levels V1~V5; and a plurality of N-channel MOS transistors M1~M5 as a grounding circuit for grounding the above power source lines VL1~VL5 in response to the logical value of the node A that is an output signal of the detector. The power source of the level comparator 51 co-uses the power source line VL1. Each of the following resistances, that is, a resistance R1 provided on the VDD power source line, resistances R2~R6 on power source lines VL1~VL5, respectively, and a resistance R7 on the power source line VL1 of the level comparator 51, is a noise absorption resistance for absorbing the undesirable noise from the corresponding power source line.

Each of the embodiments as will be described in the following is characterized by a circuit for shorting the power source lines VL1~VL5, which is added to the prior art power down short circuit 50 as shown in FIG. 9. In the following description and certain figures of the accompanying drawings related to these embodiments, the same constituents as those which constitute the prior art power down short circuit 50 are designated with the reference numerals and characters identical thereto, thereby omitting the repetitive and redundant description thereabout. Each embodiment according to the invention will now be described focusing on the short circuit which is a significant constituent characterizing each embodiment.

[First Embodiment]

Figure 2:
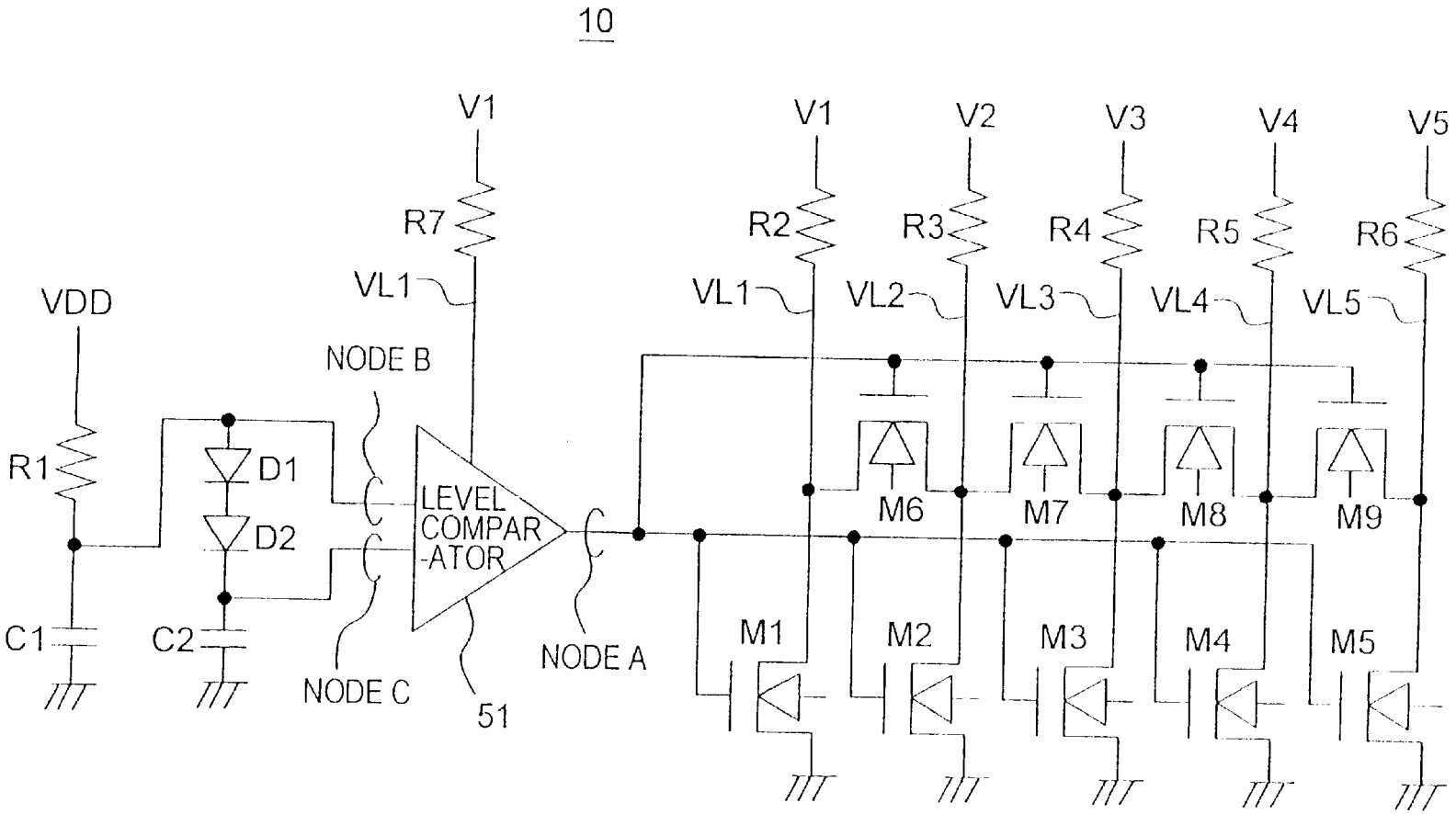
FIG. 2 is a circuit diagram of a power down short circuit according to the first embodiment of the invention.

Referring now to FIG. 2 showing a power down short circuit 10 according to the first embodiment of the invention, this circuit is characterized in that there are provided, in addition to the prior art power down short circuit as shown in FIG. 9, a plurality of N-channel MOS transistors M6~M9 serving as a circuit for shorting adjacent power source lines from among the power source lines VL1~VL5.

The connective relation of these N-channel MOS transistors M6~M9 serving as the above short circuit is as follows.

The gate of the N-channel MOS transistor M6 is connected with the node A, the source of the same is connected with a common node with which the drain of the N-channel MOS transistor M1 is connected, and the drain of the same is connected with a common node with which the drain of the N-channel MOS transistor M2 is connected.

The gate of the N-channel MOS transistor M7 is connected with the node A, the source of the same is connected with a common node with which the drain of the N-channel MOS transistor M2 is connected, and the drain of the same is connected with a common node with which the drain of the N-channel MOS transistor M3 is connected.

The gate of the N-channel MOS transistor M8 is connected with the node A, the source of the same is connected with a common node with which the drain of the N-channel MOS transistor M3 is connected, and the drain of the same is connected with a common node with which the drain of the N-channel MOS transistor M4 is connected.

The gate of the N-channel MOS transistor M9 is connected with the node A, the source of the same is connected with a common node with which the drain of the N-channel MOS transistor M4 is connected, and the drain of the same is connected with a common node with which the drain of the N-channel MOS transistor M5 is connected.

With such an arrangement of N-channel MOS transistors M1~M5 and M6~M9 as described above, as the power source of the liquid crystal panel is turned off, the power down short circuit 10 begins to operate and the level of the node A becomes the H-level. With this level change of the node A to the H-level, the N-channel MOS transistors M1~M5 are turned on, thereby the power source lines VL1~VL5 provided corresponding to the voltage level V1~V5 being grounded. At the same time, N-channel MOS transistors M6~M9 are turned on with the above level change of the node A, thereby each level between any two from among power source lines VL1~VL5 being controlled so as to approach an equal level.

As discussed above, the power down short circuit 10 according to the first embodiment can reduce the level of each power source line in a much shorter fall time than the prior art power down short circuit. Accordingly, it becomes possible to prevent the liquid crystal element from being lit due to the slow falling time of the electric potential of the power source line, thus being able to prevent any afterglow from coming out on the liquid crystal display panel.

[Second Embodiment]

Figure 3:
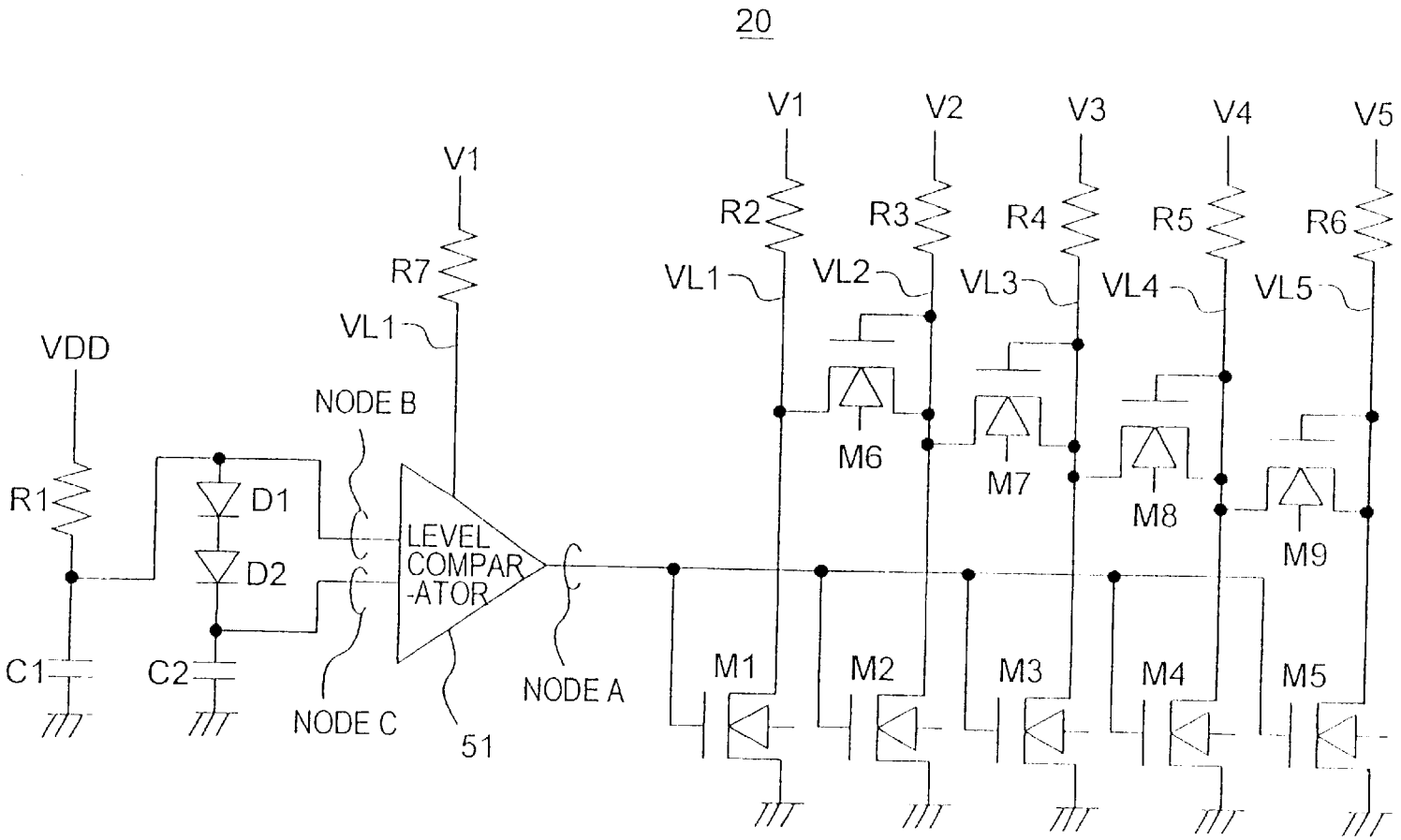
FIG. 3 is a circuit diagram of a power down short circuit according to the second embodiment of the invention.

Referring now to FIG. 3 showing a power down short circuit 20 according to the second embodiment of the invention, this circuit is characterized in that there are provided, in addition to the prior art power down short circuit as shown in FIG. 9, a plurality of N-channel MOS transistors M6~M9 serving as a circuit for shorting power source lines VL1~VL5. These N-channel MOS transistors M6~M9 are characterized in that they can short-circuit the adjacent power source lines from among the power source lines VL1~VL5 without inverting the order of their relative level height.

The connective relation of these N-channel MOS transistors M6~M9 serving as the above short circuit is as follows.

The gate and source of the N-channel MOS transistor M6 are connected with a common node with which the drain of the N-channel MOS transistor M2 is connected, and the drain of the same is connected with a common node with which the drain of the N-channel MOS transistor M1 is connected.

The gate and source of the N-channel MOS transistor M7 are connected with a common node with which the drain of the N-channel MOS transistor M3 is connected, and the drain of the same is connected with a common node with which the drain of the N-channel MOS transistor M2 is connected.

The gate and source of the N-channel MOS transistor M8 are connected with a common node with which the drain of the N-channel MOS transistor M4 is connected, and the drain of the same is connected with a common node with which the drain of the N-channel MOS transistor M3 is connected.

The gate and source of the N-channel MOS transistor M9 is connected with a common node with which the drain of the N-channel MOS transistor M5 is connected, and the drain of the same is connected with a common node with which the drain of the N-channel MOS transistor M4 is connected.

When the VDD power source is turned off, the power down short circuit 20 begins to operate and the level of the node A becomes the H-level. With this level change of the node A to the H-level, the N-channel MOS transistors M1~M5 are turned on, thereby the power source lines VL1~VL5 as provided corresponding to the voltage level V1~V5 being shot-circuited to the ground. At this time, in this second embodiment, the N-channel MOS transistor M6 acts to prevent the voltage level of the source power line VL1 from coming down to a voltage level lower than the voltage level of the power source line VL2.

That is, if the voltage level V1 tries to become lower than the voltage level V1 i.e. the voltage level V1<the voltage level V2, the gate level of the N-channel MOS transistor M6 becomes higher than the source voltage (on the connection side of resistance R2) of the N-channel MOS transistor M6, thereby the transistor M6 being turned on. Thereafter, the level of the voltage level V2 goes down until the source and drain voltages of the transistor M6 become almost equal to each other. As the result of this, the voltage level V1 becomes larger than the voltage level V2.

In the similar manner, the N-channel MOS transistor M7 acts to prevent the voltage level of the source power line VL2 from coming down to a voltage level lower than the voltage level of the power source line VL3.

The N-channel MOS transistor M8 acts to prevent the voltage level of the source power line VL3 from coming down to a voltage level lower than the voltage level of the power source line VL4.

The N-channel MOS transistor M9 acts to prevent the voltage level of the source power line VL4 from coming down to a voltage level lower than the voltage level of the power source line VL5.

Like this, according to the second embodiment of the invention, as the voltage level comes down holding the relation of V1>V2>V3>V4>V5 unchanged, the following effects can be brought about.

Figure 7:
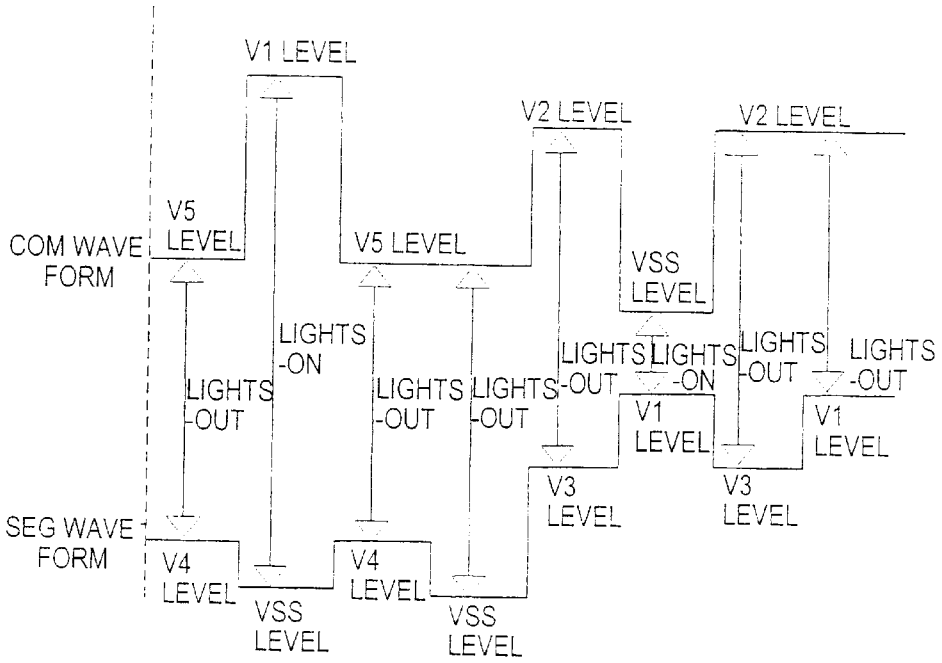
FIG. 7 shows wave forms drawn by the SEG and COM electrodes and displayed on the liquid crystal display panel.
Figure 8:
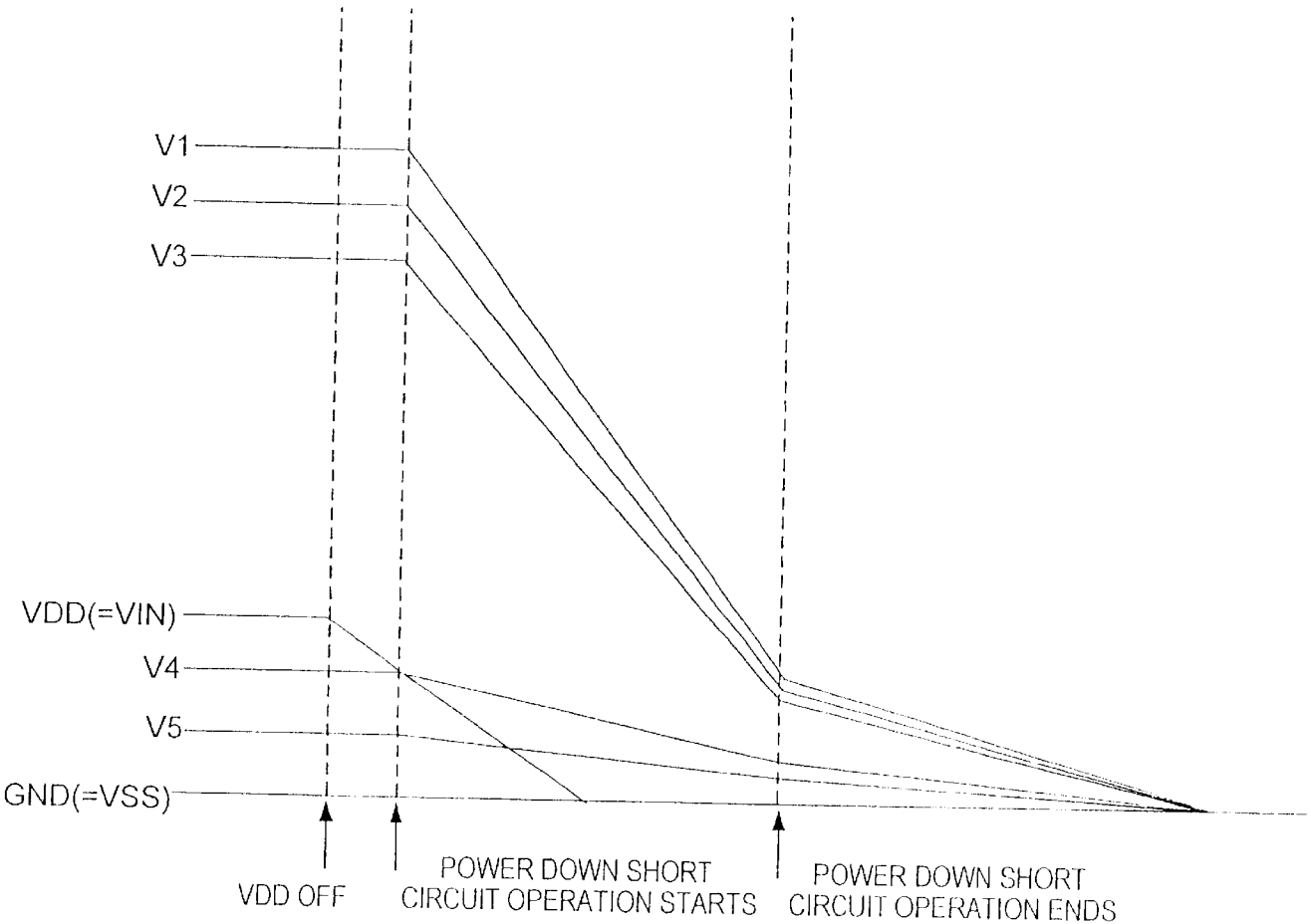
FIG. 8 is a diagram showing the change in the electric potential of the power source line when turning off the liquid crystal display panel.

The respective voltages of V1, V2, V3, V4 and V5 are still under the influence of condensers as employed in the power down short circuit even after cutting out the supply from the VDD power source, so that the above voltages come to be held at certain levels, respectively, in other words, some of liquid crystal elements are obliged to remain in such a state that electric charges are not completely swept away therefrom. Referring to FIG. 7 again, when putting the liquid crystal element in the lights-on state under the ordinary condition, the voltage of |V1−VSS| is applied between the COM and the SEG. On one hand, when putting the liquid crystal element in the lights-out state with regard to the selected COM, the voltage of |V1−V4| or |VSS−V3| is applied between the COM and the SEG, and also when putting the liquid crystal element in the lights-out state with regard to the non-selected COM, the voltage |V5−VSS| or |V5−V4| is applied between the COM and the SEG or the voltage |V2−V3| or |V2−V1| is applied between the COM and the SEG. In this state, the COM signal varies at a specific duty.

On one hand, when the supply from the VDD power source is cut out, the signal of the COM no more operates at the specific duty, and also, the data of the SEG is no more supplied. Accordingly, any one from among the voltages V1, V5, V2 and VSS must be applied to each of the COM lines, but it is uncertain which voltage is applied thereto. Similarly, any one from among the voltages V4, VSS, V3 and V1 must be applied to each of the SEG lines, but it is uncertain which voltage is applied thereto.

Figure 4A:
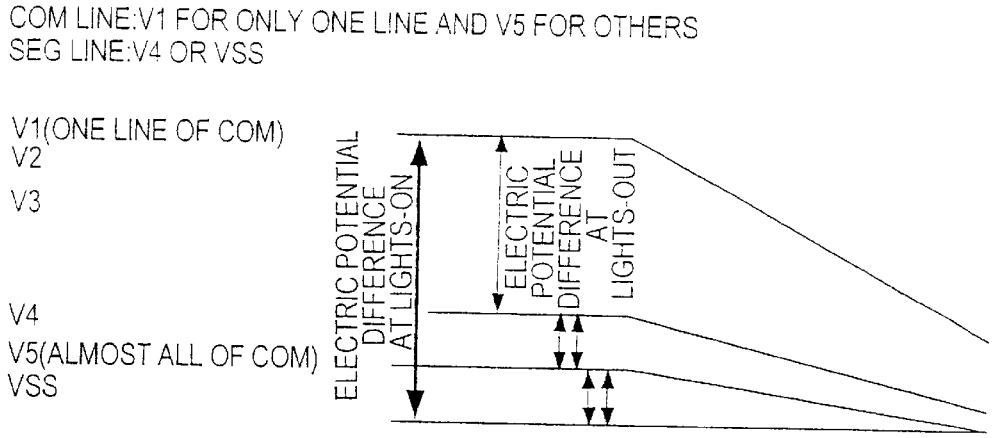
FIGS. 4(*a*) and 4(*b*) are diagrams for describing how the voltage level of the liquid crystal element is changed, FIG. 4(*a*) corresponding to Case 1 and FIG. 4(*b*) corresponding to Case 2.
Figure 4B:
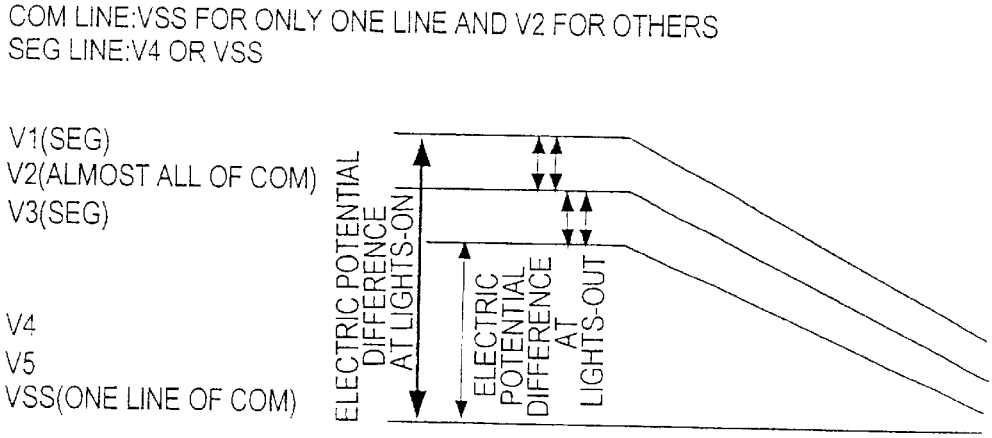

Referring to FIGS. 4(*a*) and 4(*b*), the voltage having been applied to the liquid crystal element in a moment of cutting out the supply from the VDD power source, takes values as shown in the following two cases.

(Case 1) COM lines: V1 for only 1 line, V5 for others
SEG lines: V4 or VSS (FIG. 4(*a*))

(Case 2) COM lines: VSS for only 1 line, V2 for others
SEG lines: V3 or V1 (FIG. 4(*b*))

In order to prevent the afterglow from coming out on the liquid crystal display panel, it is needed to completely sweep out the electric charges remaining on the liquid crystal elements. However, since it is uncertain which voltage level is applied to each of the COM and SEG lines, it should be effective to lower the level of the voltages V1 through V5 as a whole. In case of executing this effective way with regard to the Case 1 as shown in FIG. 4(*a*), it is desirable to change the levels of voltages V4 and V5 such that the level difference therebetween is kept unchanged before and after the level change. Similarly, in case of the Case 2 as shown in FIG. 4(*b*), it is desirable to change the voltage levels |V1−V2| and |V2−V3| such that the level difference therebetween is kept unchanged. However, when taking account of that it is uncertain which case takes place, Case 1 or Case 2, it should be effective for preventing the afterglow from coming out on the liquid crystal display panel to lower the whole voltage levels V1 through V5, keeping the relative level height order of their voltage, that is, V1>V2>V3>V4>V5 unchanged.

Accordingly, the afterglow coming out on the liquid crystal display panel can be erased by preventing the lights-on of the liquid crystal element that is caused by the slow fall time of the electric potential of the power source line.

[Third Embodiment]

Figure 5:
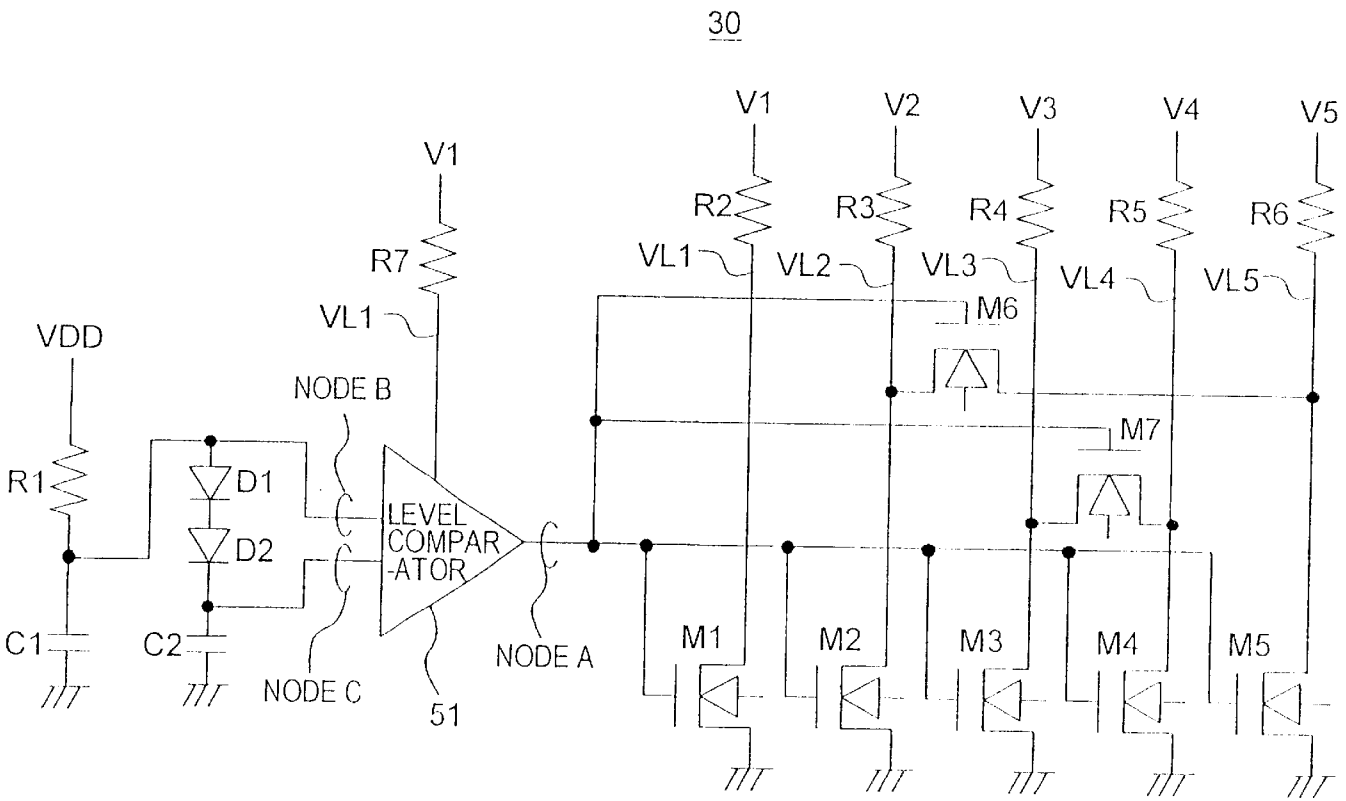
FIG. 5 is a circuit diagram of a power down short circuit according to the third embodiment of the invention.

Referring now to FIG. 5 showing a power down short circuit 30 according to the third embodiment of the invention, this circuit is characterized in that there are provided, in addition to the prior art power down short circuit as shown in FIG. 9, two N-channel MOS transistors M6 and M7 serving as a circuit for shorting power source lines VL1~VL5. These N-channel MOS transistors M6 and M7 are characterized in that they short-circuit the power source lines VL2 and VL5 provided corresponding to the lights-out level V2 and V5 of the COM, and also short-circuit the power lines VL3 and VL4 provided corresponding to the lights-out levels V3 and V4 of the SEG.

The connective relation of these N-channel MOS transistors M6 and M7 serving as the above short circuit is as follows.

The gate of the N-channel MOS transistor M6 is connected with the node A, the drain of the same is connected with a common node with which the drain of the N-channel MOS transistor M2 is connected, and the source of the same is connected with a common node with which the drain of the N-channel MOS transistor M5 is connected.

The gate of the N-channel MOS transistor M7 is connected with the node A, the drain of the same is connected with a common node with which the drain of the N-channel MOS transistor M3 is connected, and the source of the same is connected with a common node with which the drain of the N-channel MOS transistor M4 is connected.

In the Case 1 of FIG. 4(*a*), three levels of V1 (lights-on level on the COM side), V5 (lights-out level on the COM side) and V4 (lights-out level on the SEG side) exert influence on the afterglow. In the Case 2 of FIG. 4(*b*), three levels of V1 (lights-on level on the SEG side), V2 (lights-out level on the COM side) and V3 (lights-out level on the SEG side) exert influence on the afterglow. As previously described, it is uncertain which case takes place, Case 1 or Case 2, but it is certain that one of them never fails to take place.

In this third embodiment, light-out levels on the COM side (V2−V5) and light-out levels on the SEG side (V3−V4) are respectively short-circuited each other, so that the fall time of V4 and V5 levels becomes slow in the Case 1 while the fall time of V2 and V3 levels becomes fast in the Case 2. It is still uncertain which case takes place more often, Case 1 or Case 2, but this embodiment has such an effect as shortens the fall time of the levels of V2 through V5 as a whole.

Accordingly, the afterglow coming out on the liquid crystal display panel can be erased by preventing the lights-on of the liquid crystal element that is caused by the slow fall time of the electric potential of the power source line.

[Fourth Embodiment]

Figure 6:
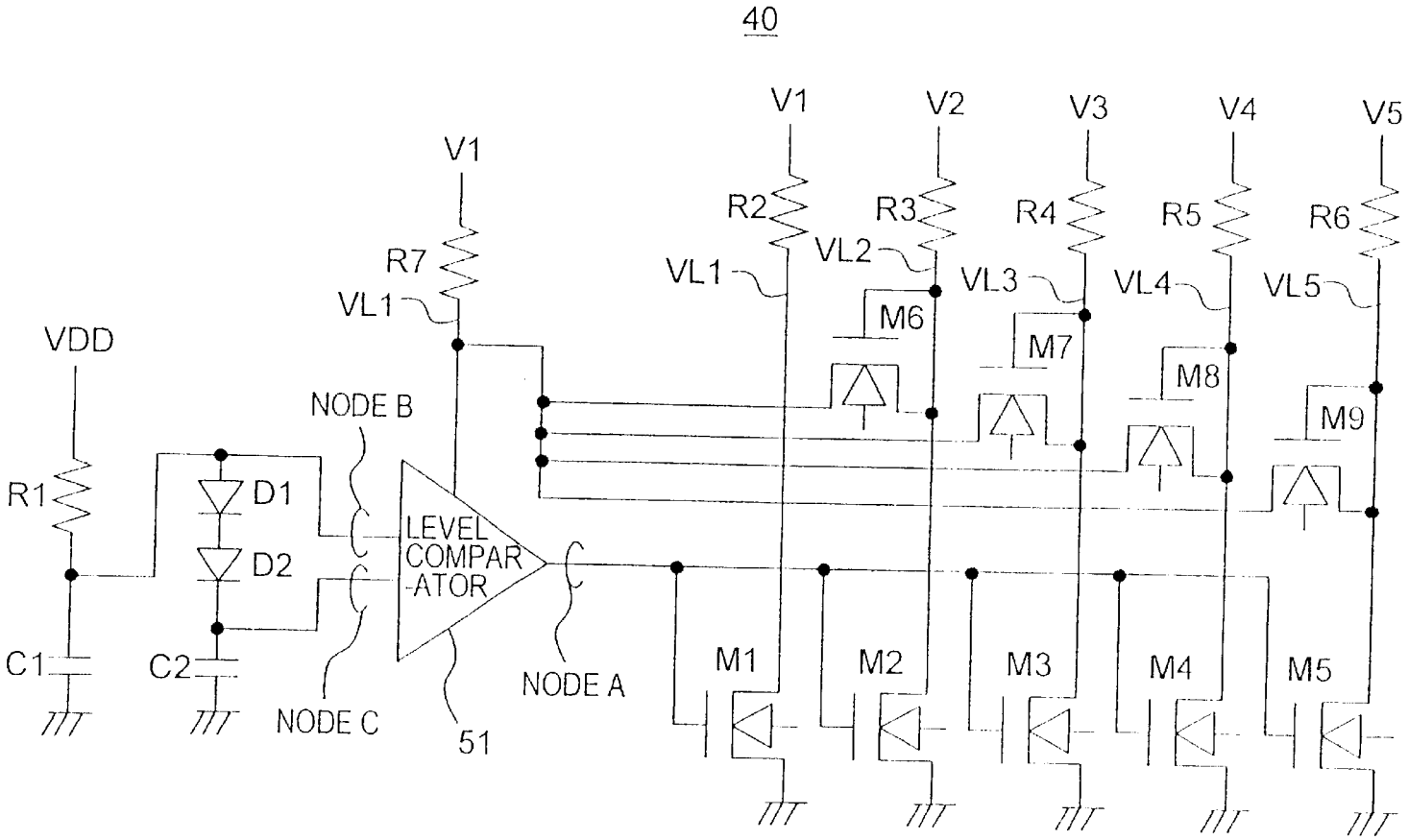
FIG. 6 is a circuit diagram of a power down short circuit according to the fourth embodiment of the invention.

Referring now to FIG. 6 showing a power down short circuit 40 according to the fourth embodiment of the invention, this circuit is characterized in that there are provided, in addition to the prior art power down short circuit as shown in FIG. 9, a plurality of N-channel MOS transistors M6~M9 serving as a circuit for shorting power source lines VL1~VL5. Furthermore, these N-channel MOS transistors M6~M9 are characterized in that they short-circuit the power source line VL1 provided for the maximum voltage level V1 and each of other power source lines VL2~VL5 one another.

The connective relation of these N-channel MOS transistors M6~M9 serving as the above short circuit is as follows.

The gate and source of the N-channel MOS transistor M6 are connected with a common node with which the drain of the N-channel MOS transistor M2 is connected, and the drain of the same is connected with the power source node of the level comparator 51.

The gate and source of the N-channel MOS transistor M7 are connected with a common node with which the drain of the N-channel MOS transistor M3 is connected, and the drain of the same is connected with the power source node of the level comparator 51.

The gate and source of the N-channel MOS transistor M8 are connected with a common node with which the drain of the N-channel MOS transistor M4, and the drain of the same is connected with the power source node of the level comparator 51.

The gate and source of the N-channel MOS transistor M9 is connected with a common node with which the drain of the N-channel MOS transistor M5 is connected, and the drain of the same is connected with the power source node of the level comparator 51.

When the VDD power source is turned off, the power down short circuit 40 begins to operate, by which the level of the node A is changed from L-level to the H-level. With this level change of the node A to the H-level, the N-channel MOS transistors M1~M5 are turned on, thereby the power source lines VL1~VL5 as provided corresponding to the voltage level V1~V5 being shot-circuited. At this time, in this fourth embodiment, the N-channel MOS transistor M6 acts to prevent the voltage level of the source power line VL1 from coming down to a voltage level lower than the voltage level of the power source line VL2.

That is, if the voltage level V1 tries to become lower than the voltage level V2, that is, the voltage level V1<the voltage level V1, the gate level of the N-channel MOS transistor M6 becomes higher than the source voltage (on the connection side of resistance R2), thereby the transistor M6 being turned on. Thereafter, the level of the voltage level V2 goes down until the source and drain voltages of the transistor M6 become almost equal to each other. As the result of this, the voltage level V1 becomes larger than the voltage level V2.

Similarly, the N-channel MOS transistor M7 acts to prevent the voltage level of the source power line VL1 from coming down to a voltage level lower than the voltage level of the power source line VL3.

The N-channel MOS transistor M8 acts to prevent the voltage level of the source power line VL1 from coming down to a voltage level lower than the voltage level of the power source line VL4.

The N-channel MOS transistor M9 acts to prevent the voltage level of the source power line VL1 from coming down to a voltage level lower than the voltage level of the power source line VL5.

As each of voltage levels V1 through V5 comes to have relations of V1≧V2, V1≧V3, V1≧V4 and V1≧V5, the H-level of the node A generated from the level comparator 51 using the voltage level V1 as the power source always takes a value equal to or larger than the maximum value among the voltage levels V2~V5 as each of voltage levels V2~V5 is going down. The H-level of this node A can effectively work even near the threshold value of the transistor for use in discharge, so that each level of the power source lines VL1~VL5 can surely drop down up to the value near the threshold value of the transistor for use in discharge. Accordingly, as described previously, the afterglow coming out on the liquid crystal display panel can be erased by preventing the lights-on of the liquid crystal element that is caused by the slow fall time of the electric potential of the power source line.

While preferred embodiments of the power source for driving the liquid crystal display panel according to the invention have been discussed with referring to the accompanying drawings, the invention is not limited to these embodiments as shown in the drawings and described in this specification. It will be apparent to those skilled in the art that changes and modifications can be made without departing from the principle and spirit of the invention, the scope of which is defined in the appended claims, and it is understood that those changes and modifications also belong to the technical scope of the invention.

What is claimed is:

1. A power circuit for driving a liquid crystal display panel comprising:

a voltage generator for generating a plurality of voltage levels for driving a liquid crystal display panel;

a plurality of power source lines provided corresponding to said plurality of voltage levels;

a detector for detecting if said liquid crystal display panel has been turned off;

a grounding circuit for grounding said plurality of power source lines in response to the detection result obtained by said detector; and a circuit for shorting predetermined power source lines each other in response to the detection result obtained by said detector, wherein said short circuit shorts adjacent power source lines from among said plurality of power source lines each other.

2. A power circuit for driving a liquid crystal display panel as claimed in claim 1, wherein said short circuit comprises a plurality of MOS transistors short-circuiting said power source lines each other, and each of said MOS transistor gates is connected with said detector.

3. A power circuit for driving a liquid crystal display panel as claimed in claim 1, wherein said plurality of voltage levels comprise;

a first voltage level which is arbitrarily set to meet the characteristic of said liquid crystal display panel;

a second voltage level which is a lights-out level of the COM electrode led out in the lateral direction from among electrodes provided on two of said liquid crystal display panel;

a third voltage level which corresponds to said second voltage level and is a lights-out level of the SEG electrode led out in the longitudinal direction from among electrodes provided on two of said liquid crystal display panel;

a fourth voltage level which is a lights-out level of the SEG electrode led out in the longitudinal direction from among electrodes provided on two of said liquid crystal display panel; and a fifth voltage level which corresponds to said fourth voltage level and is a lights-out level of the COM electrode led out in the lateral direction from among electrodes provided on two of said liquid crystal display panel.

4. A power circuit for driving a liquid crystal display panel comprising:

a voltage generator for generating a plurality of voltage levels for driving a liquid crystal display panel;

a plurality of power source lines provided corresponding to said plurality of voltage levels;

a detector for detecting if said liquid crystal display panel has been turned off;

a grounding circuit for grounding said plurality of power source lines in response to the detection result obtained by said detector; and a circuit for shorting predetermined power source lines in response to the detection result obtained by said detector, wherein said short circuit shorts adjacent power source lines from among said plurality of power source lines without inverting the relative level height order of the electric potential of said plurality of power source lines.

5. A power circuit for driving a liquid crystal display panel as claimed in claim 4, wherein said short circuit comprises a plurality of MOS transistors short-circuiting said power source lines each other, and each gate of said MOS transistors is connected with the power source line from among the adjacent power source lines, which is kept at the lower voltage level.

6. A power circuit for driving a liquid crystal display panel as claimed in claim 4, wherein said plurality of voltage levels comprise;

a first voltage level which is arbitrarily set to meet the characteristic of said liquid crystal display panel;

a second voltage level which is a lights-out level of the COM electrode led out in the lateral direction from among electrodes provided on two of said liquid crystal display panel;

a third voltage level which corresponds to said second voltage level and is a lights-out level of the SEG electrode led out in the longitudinal direction from among electrodes provided on two of said liquid crystal display panel;

a fourth voltage level which is a lights-out level of the SEG electrode led out in the longitudinal direction from among electrodes provided on two of said liquid crystal display panel; and a fifth voltage level which corresponds to said fourth voltage level and is a lights-out level of the COM electrode led out in the lateral direction from among electrodes provided on two of said liquid crystal display panel.

7. A power circuit for driving a liquid crystal display panel comprising:

a voltage generator for generating a plurality of voltage levels for driving a liquid crystal display panel;

a plurality of power source lines provided corresponding to said plurality of voltage levels;

a detector for detecting if said liquid crystal display panel has been turned off;

a grounding circuit for grounding said plurality of power source lines in response to the detection result obtained by said detector; and a circuit for shorting predetermined power source lines each other in response to the detection result obtained by said detector, wherein said short circuit shorts the power source lines provided in correspondence with the lights-out level of the COM electrodes of said liquid crystal display panel and also short-circuits the power source lines provided in correspondence with the lights-out level of the SEG electrodes of said liquid crystal display panel.

8. A power circuit for driving a liquid crystal display panel as claimed in claim 7, wherein said short circuit comprises a plurality of first MOS transistors short-circuiting said power source lines provided in correspondence with the lights-out level of the COM electrodes of said liquid crystal display panel, and a plurality of second MOS transistors short-circuiting said power source lines provided in correspondence with the lights-out level of the SEG electrodes of said liquid crystal display panel, and respective gates of said first and second MOS transistors are connected with said detector.

9. A power circuit for driving a liquid crystal display panel as claimed in claim 7, wherein said plurality of voltage levels comprise;

a first voltage level which is arbitrarily set to meet the characteristic of said liquid crystal display panel;

a second voltage level which is a lights-out level of the COM electrode led out in the lateral direction from among electrodes provided on two of said liquid crystal display panel;

a third voltage level which corresponds to said second voltage level and is a lights-out level of the SEG electrode led out in the longitudinal direction from among electrodes provided on two of said liquid crystal display panel;

a fourth voltage level which is a lights-out level of the SEG electrode led out in the longitudinal direction from among electrodes provided on two of said liquid crystal display panel; and a fifth voltage level which corresponds to said fourth voltage level and is a lights-out level of the COM electrode led out in the lateral direction from among electrodes provided on two of said liquid crystal display panel.

10. A power circuit for driving a liquid crystal display panel as claimed in claim 9, wherein said short circuit comprises the first MOS transistor connecting the power source line provided in correspondence with said second voltage level with the power source line provided in correspondence with said fifth voltage level, and the second MOS transistor connecting the power source line provided in correspondence with said third voltage level with the power source line provided in correspondence with said fourth voltage level, and the respective gates of first and second MOS transistors are connected with said detector.

11. A power circuit for driving a liquid crystal display panel comprising:

a voltage generator for generating a plurality of voltage levels for driving a liquid crystal display panel;

a plurality of power source lines provided corresponding to said plurality of voltage levels;

a detector for detecting if said liquid crystal display panel has been turned off;

a grounding circuit for grounding said plurality of power source lines in response to the detection result obtained by said detector; and a circuit for shorting predetermined power source lines each other in response to the detection result obtained by said detector, wherein said short circuit shorts said power source line provided in correspondence with the maximum voltage level and each of said other power source lines, each other.

12. A power circuit for driving a liquid crystal display panel as claimed in claim 11, wherein said short circuit comprises a plurality of MOS transistor short-circuiting said power source line provided in correspondence with the maximum voltage level and each of said other power source lines, each other.

13. A power circuit for driving a liquid crystal display panel as claimed in claim 11, wherein said plurality of voltage levels comprise;

a first voltage level which is arbitrarily set to meet the characteristic of said liquid crystal display panel;

a second voltage level which is a lights-out level of the COM electrode led out in the lateral direction from among electrodes provided on two of said liquid crystal display panel;

a third voltage level which corresponds to said second voltage level and is a lights-out level of the SEG electrode led out in the longitudinal direction from among electrodes provided on two of said liquid crystal display panel;

a fourth voltage level which is a lights-out level of the SEG electrode led out in the longitudinal direction from among electrodes provided on two of said liquid crystal display panel; and a fifth voltage level which corresponds to said fourth voltage level and is a lights-out level of the COM electrode led out in the lateral direction from among electrodes provided on two of said liquid crystal display panel.

* * * * *